United States Patent [19]

Tordoff

[11] 4,295,515

[45] Oct. 20, 1981

[54] AUTOMATIC CONE AND MOLD-MAKING MACHINE

[75] Inventor: William L. Tordoff, Worthington, Ohio

[73] Assignee: Ashland Oil, Inc., Ashland, Ky.

[21] Appl. No.: 131,915

[22] Filed: Mar. 20, 1980

[51] Int. Cl.[3] ..... B22C 11/04; B22C 13/14; B22C 17/12

[52] U.S. Cl. ..... 164/158; 164/161; 164/181; 164/183; 164/203

[58] Field of Search ..... 164/181, 183, 224, 228; 425/215, 262, 161, 164, 158, 203

[56] References Cited

U.S. PATENT DOCUMENTS

| | | | |
|---|---|---|---|
| 788,601 | 5/1905 | Root | 164/158 |
| 2,846,739 | 8/1958 | Hallsworth | 164/181 |
| 3,343,237 | 9/1967 | Burton et al. | 425/262 |
| 3,528,481 | 9/1970 | Lund | 164/183 |
| 4,083,396 | 4/1978 | Michelson | 164/181 X |

FOREIGN PATENT DOCUMENTS

| | | | |
|---|---|---|---|
| 17425 | 5/1971 | Japan | 164/181 |
| 537222 | 7/1973 | Switzerland | 164/161 |
| 246783 | 11/1969 | U.S.S.R. | 164/228 |
| 561607 | 6/1977 | U.S.S.R. | 164/181 |

*Primary Examiner*—Robert D. Baldwin
*Attorney, Agent, or Firm*—Wood, Herron & Evans

[57] ABSTRACT

An automatic no-bake core and mold-making machine. A frame is rotatably mounted on a base and carries a plurality of core-forming patterns around its periphery. Plates surround the patterns to form a continuous, flat surface interrupted only by the pattern cavity. A mixing machine located adjacent to the rotating frame continuously pours sand and binder on the patterns and surrounding plates. A stationary plow under which the plates and patterns pass continuously wipes excess sand and binder into the next succeeding pattern passing below the plow. Means are provided for ejecting the cores from the patterns after they are cured.

7 Claims, 9 Drawing Figures

55
57
56
36
25
29
28
30
31
32
27
26
11
13
12
14
16
17
10
39
51
50
35
41
40
49

36
47
46
43
42
44
25

12
10
35
28
27
36
5-5
25
31
32
30
29
40
49
26

26
10
35
12
39
40
27
36
25
30
31
29
51
49

AUTOMATIC CONE AND MOLD-MAKING MACHINE

This invention relates to core and mold-making machines, which for convenience will be referred to as core-making machines. More particularly, the invention is directed to a continuously operating, automatic core-making machine. In general, the invention is concerned with foundry practices wherein sand cores are made for future use in the pouring of molten metal castings. In general, green sand is mixed with a binder, and while it is still flowable, it is poured into a pattern. In the pattern the binder cures and binds the sand particles together in the three dimensional shape desired for the core. The core is thereafter mounted in a mold into which molten metal is poured to make the metal casting.

For many years, cores have been made and are still being made by mixing a thermosetting binder with sand, pouring the thus sand and binder combination into a pattern and then baking that core in an oven until the binder cures. The pattern is usually in the form of an upward-facing cavity. The pattern could be a full core, or could be a half core with two core halves being joined together by an adhesive after the core halves are formed and the binder cured.

A pattern is conveyed under a mixer. The sand and binder mixture is poured into the pattern in an amount slightly in excess of that required to fill the pattern. Workmen wipe off the excess, preferably depositing the excess into the next incoming pattern, and the pattern is moved to the oven for curing. After the core is cured and cooled, the core is removed from the pattern by turning the pattern upside down onto a conveyor. Usually this is a hand operation unless the core and pattern weigh in excess of 40 pounds, and then the pattern is overturned by machinery. Once the pattern is emptied of its core, the pattern is returned to the mixing station for a new cycle.

The process which has been described is extremely slow. Additionally, to the extent that heat is required to cure the cores, considerable energy is involved. Not only must the temperature of the binder be raised, but obviously all of the sand surrounded by the binder must be raised in temperature to the same extent.

Within the last twenty years or so, "no-bake" binders have become available and have been used. The no-bake binders cure without subjecting the binder to heat. Their use therefore reduces the energy required for the core-making process.

More recently, about ten years ago, a new no-bake binder system was introduced with certain unusual features (see U.S. Pat. No. 3,676,392). That binder system provides a three-part system consisting of a resin, hardener and a catalyst which determines the speed of the curing reaction. The speed with which curing takes place is dependent upon the amount of catalyst used. One characteristic of the system is that the binder remains extremely flowable with no perceptible curing for an extended period of time. Another characteristic of the binder is that when the time for curing arrives, the curing of the binder is almost instantaneous.

The introduction of the no-bake binder systems has produced no significant changes in the machinery used to make cores aside from the fact that machinery was made to operate faster than heretofore had been possible with other binder systems. The operation still remains a relatively slow and laborious, largely hand operation as described above.

An objective of the present invention has been to take advantage of some of the features of the no-bake binder system, particularly that of the '392 patent, and provide a core-making machine which is substantially fully automatic and continuously operating, thereby eliminating the batch-type processing of cores which has been used heretofore in other no-bake systems.

This objective of the invention is attained by providing a rotatable frame carrying patterns spaced around the periphery of the frame. Plate segments are mounted on the frame and surround the individual pattern so as to form a continuous, uninterrupted surface, except for the pattern cavities, around the periphery of the frame. A continuously-operating mixer or other source of supply of said with catalyzed binder added is located immediately adjacent the rotating frame and continuously pours the sand mixture into the patterns and onto the plate segments. A plow, immediately downstream of the supply of sand, wipes across the surface of the plates moving excess sand from the plates and patterns into the next succeeding patterns.

The patterns, as they exit from underneath the plow, each have the precise amount of sand, neatly leveled off and compacted by vibrators, that is required to form the core.

Up to this point in the operation, the sand has been completely flowable. The catalyzed binder system is such, however, that as the patterns are carried through the rest of the cycle as, for example, a curing cycle of from 60 to 180 seconds, the binder will rapidly set and completely harden the core.

As indicated, the binder of the '392 patent is especially adapted for use on this continuously operating machine in that it can be introduced into the sand along with the catalyst, mixed, poured and leveled off while it is completely flowable. Thereafter, at some point during the curing interval, the characteristic of the sand is such that it changes from completely flowable to completely cured. This point in time from the introduction of the catalyst to the two-part binder system at which the complete cure will take place can be regulated with some considerable precision by the amount of catalyst introduced into the binder.

The apparatus has a discharge station which can be fully automatic or semi-automatic. In a semi-automatic embodiment, stripper pins are provided to pass through the bottom of the pattern and into the cavity in which the core is formed. The stripper pins are connected to a cam-operated mechanism which causes the stripper pins to move through the pattern to eject a core at the discharge station. A workman located at that station simply lifts the core off the frame and places it on a conveyor which takes the core away for further processing.

In a fully automatic ejection station, the patterns are mounted on the frame in such a way as to be pivotable through 180° from an upright position to an upside-down position overlying an adjacent conveyor. Again, cam-operated stripper pins are provided to eject the cores when the pattern is moved to its upside-down position.

The several features and objectives of the invention will become more readily apparent from the following detailed description taken in conjunction with the accompanying drawings in which.

DESCRIPTION

Figure 1:
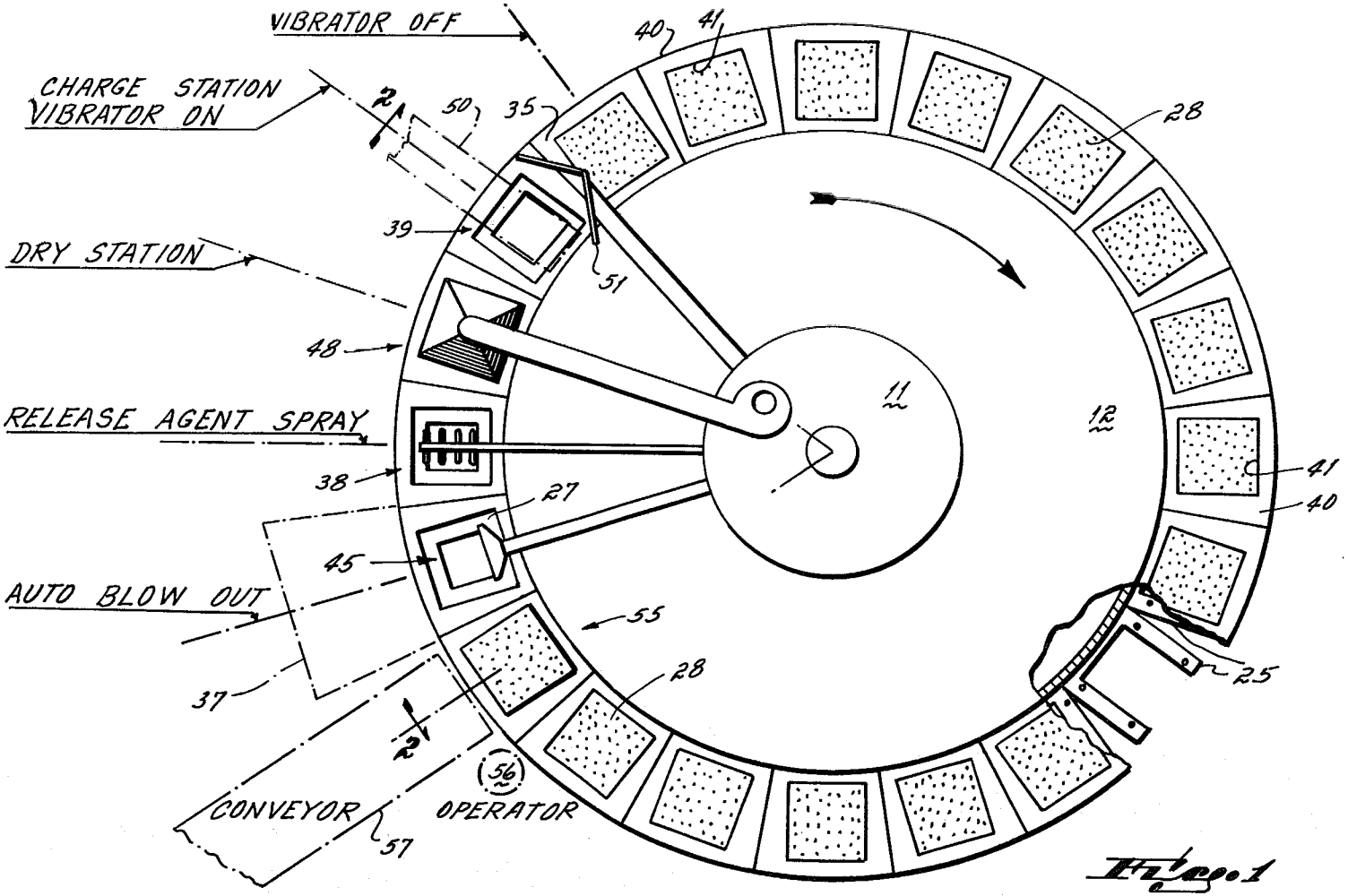
FIG. 1 is a diagrammatic top plan view of the apparatus.
Figure 2:
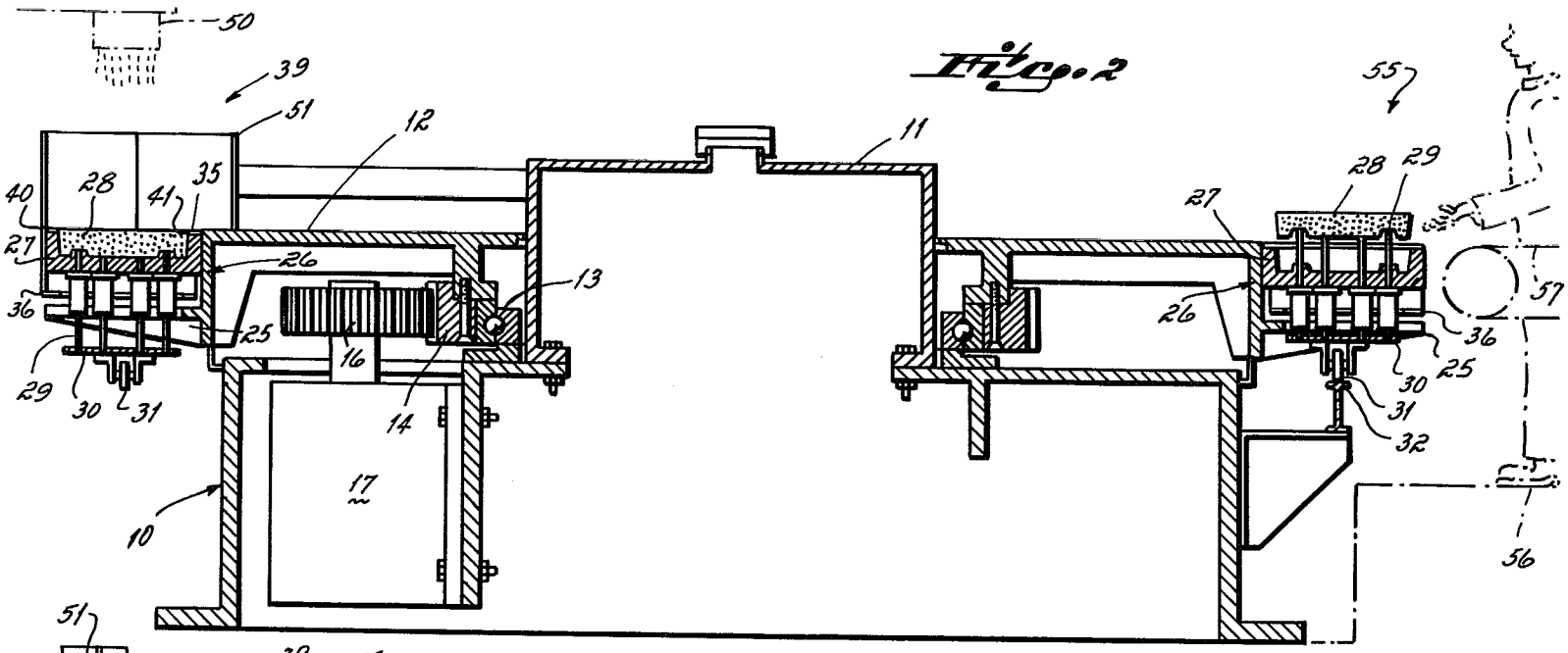
FIG. 2 is a cross-sectional view taken along lines 2—2 of FIG. 1.
Figure 3:
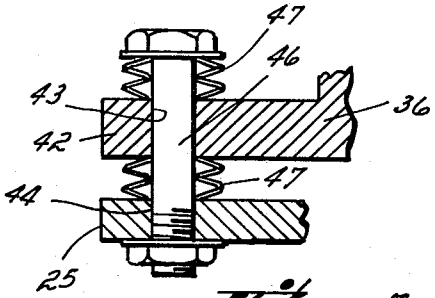
FIG. 3 is an end elevational view taken along lines 3—3 of FIG. 2.

The apparatus consists of a base 10 to which is fixed a central hub 11. A rotary frame 12 is mounted by bearings 13 on the base around the hub 11. The frame carries a gear ring 14 which is engaged by a pinion gear 16 driven by a variable speed hydraulic motor 17.

The length of time of the curing cycle can be varied within quite a wide range. It is contemplated, however, that the apparatus of the present invention should be operated at about one-fourth to one revolution per minute.

The frame 12 carries a pair of support beams 25 at every position on the frame, there being twenty positions for tooling around the circumference of the frame in the illustrated form of the invention.

Figure 4:
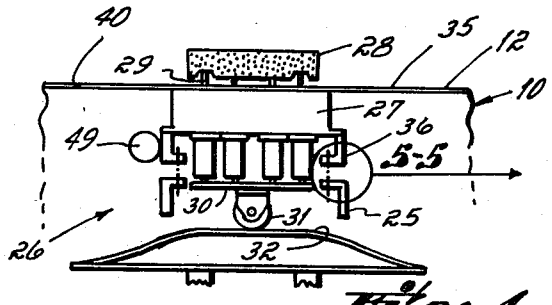
FIG. 4 is an end elevational view taken along lines 4—4 of FIG. 2.

The support beams carry the tooling 26 which includes a pattern or drag 27 into which the core or mold 28 is formed. The tooling also includes ejection pins 29 which are mounted on a stripper plate 30. The stripper plate carries a follower roller 31 which is adapted to ride on a cam 32 (FIG. 4) to strip the core from the pattern or drag after the core has cured, as will be described below. The top surface of the pattern is indicated at 35 and is formed in part by a segment plate 40 which overlies and surrounds the pattern. One segment plate 40 is provided for each core positioned around the frame, and all segment plates are mounted in abutting relation to the adjacent segment plates so that there are no gaps between segment plates. The top surface of the segment plates lie in the same plane and each has an opening 41 through which sand is poured in the formation of the core.

Figure 5:
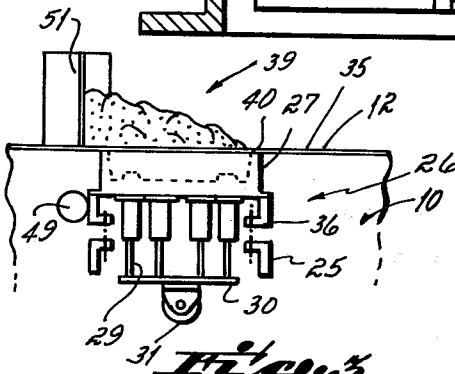
FIG. 5 is a fragmentary view of the portion of the machine encircled at 5—5 in FIG. 4.

The tooling is removable so that the machine is adaptable for making a wide variety of core configurations. The tooling includes a tooling carrier 36 which is fixed to the pattern or drag 27 and is spaced down from the drag 27. The carrier has an inwardly-directed flange 42 which is spaced down from the drag 27. The flange 42 has a series of holes 43 (FIG. 5) spaced around the perimeter of the carrier, those holes being alignable with corresponding holes 44 in the support beams 25. Bolts 46 pass through the aligned holes to secure the carrier to the support beams. The bolts are surrounded by bellville springs 47 between the carrier and the support beam as well as bellville springs 47 between the bolt head and the carrier.

A pneumatic vibrator 49 is mounted on the tooling carrier and is fed from a pneumatic source emanating from the center of the hub 11. The spring mounting, in combination with the pneumatic vibrator, causes the sand to be settled and well packed in the pattern within about 20° of rotation of the frame after the sand has been introduced into the pattern from the supply.

There are several operating stations around the circumference of the machine. The first station in the core-forming operation is an automatic blow-out station 45 wherein any residual sand remaining in the pattern or drag is blown out of the pattern so that a perfect core can be made. A waste bin 37 is positioned alongside the automatic blow-out apparatus to capture the sand.

Immediately adjacent the automatic blow-out station is a release agent spray station 38 wherein a release or parting agent is applied to the interior surface of the drag in order to facilitate the separation of the core from the pattern after the core has cured.

Adjacent the release agent spray station is a dry station 48 which blows hot air into the drag to dry the parting agent which has been applied to the station 38. Adjacent the dry station 48 is a charge station 39 wherein sand is continuously poured through a spout 50 onto the top surface of the frame 12 and particularly poured into the pattern or drag 27 carried by the frame.

Downstream from the charge station is a plow 51 which continuously wipes the upper surface of the frame as it rotates underneath the plow. The sand dispensed by the continuous mixer is continuously wiped into the pattern and plate segments with the excess being wiped into the next adjacent pattern.

Finally, there is an eject station 55 at about 200° from the mixer. The eject station includes a place for an operator to stand, indicated at 56, and a conveyor 57 adapted to carry away completed cores after they are ejected from the patterns. The cam 32. referred to above, which is engageable by the cam follower 31 to effect the ejection of the core is located at the eject station. It can be seen from FIG. 4 that when the follower 31 rides up upon the cam 32, the follower will force the stripper pins or ejection pins 29 to rise and thereby force out the now bonded aggregate which is in the desired shape of the sand core.

OPERATION OF THE FIRST EMBODIMENT

In the operation of the first embodiment, sand from the supply or mixer at the charge station 39 is poured into the pattern 27 passing underneath as well as onto the plate segments 40 surrounding the pattern. Since the sand is continuously flowing from the spout 50, the sand will necessarily cover the segment plate as well as flow into the pattern. At this point, the sand is completely flowable, for the abrupt curing reaction has not yet begun.

The frame rotates in a counterclockwise direction and causes the segment plate and pattern to move under the plow 51. As the pattern and segment plate move under the plow 51, the sand which is accumulated on top of the segment plate is swept into the pattern and the excess is continually swept off the segment plate as the frame continues to move. After the sand has been poured into the pattern and during the subsequent period until it passes under the plow, the vibrator 49 operates to compact the sand within the pattern.

Passing beyond the plow is the pattern with the sand leveled off at its upper surface and a surrounding segment plate which has been wiped clean. In that form, the pattern carries the sand slowly around to the ejection station.

At the strip station, the cam follower 31 rides up upon the cam 32 causing the stripper pins to rise and to strip the core from the pattern. The workman picks up the core and places it on the conveyor 57 where it is carried off for further processing.

After the core has been stripped, the pattern passes under the auto-blowout station 45. Air from that station is blown into the pattern to clean out the loose sand particles remaining after the core has been stripped.

At the station 38, a release agent is sprayed into the pattern so as to facilitate the ejection of the next core.

At the next station 48, the pattern is dried by blowing air into the pattern from an air supply at the hub of the apparatus. This completes the preparation of the pattern for receipt of additional sand.

It can be seen that the apparatus operates continuously with sand being continuously mixed with the binder system and the catalyst and being poured continuously onto the patterns or surrounding segment plates. At some point during the excursion between the plow 51 and the ejection place 55, the binder in the core will be completely cured. That complete curing occurs in a matter of a very few seconds and its point in time can be regulated by the amount of catalyst mixed with the binder.

EMBODIMENT OF FIGS. 6 to 9

The embodiment of FIGS. 6 to 9 is the same in all material respects as the earlier described embodiment of FIGS. 1–5 except for the eject mechanism for the cores. In the embodiment of FIGS. 6–9, the ejection is fully automatic and does not require a workman to lift the cores off from the pattern after having been ejected by the stripper pins. In the embodiment of FIGS. 6–9, the pattern is rotated so that it is upside-down before the stripper pins are actuated. Thereafter, the stripper pins are actuated to force the core downwardly out of the pattern and onto a conveyor which carries the pattern away for further processing.

Figure 6:
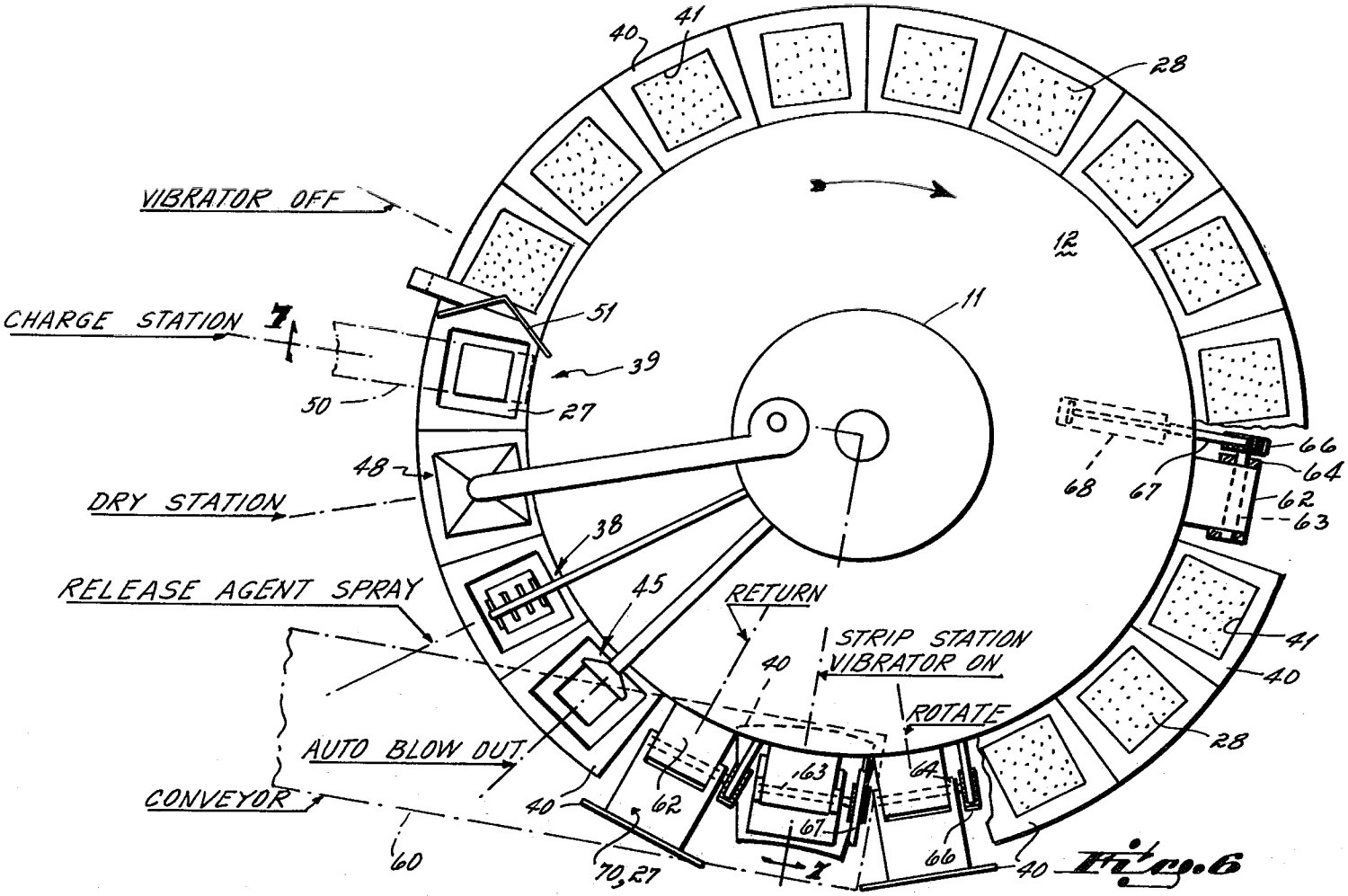
FIG. 6 is a diagrammatic plan view of an alternative embodiment of the invention.
Figure 9:
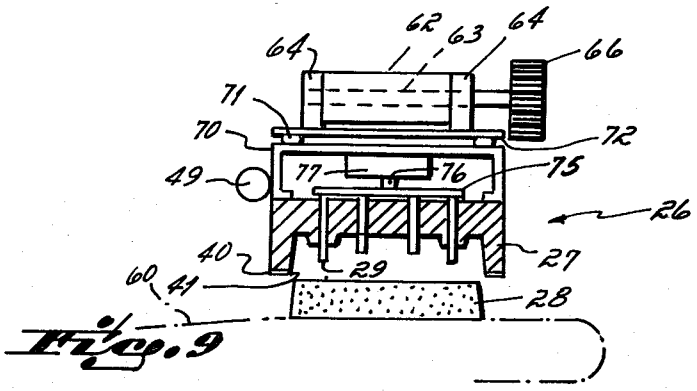
FIG. 9 is a diagrammatic cross-sectional view taken along lines 9—9 of FIG. 7.
Figure 8:
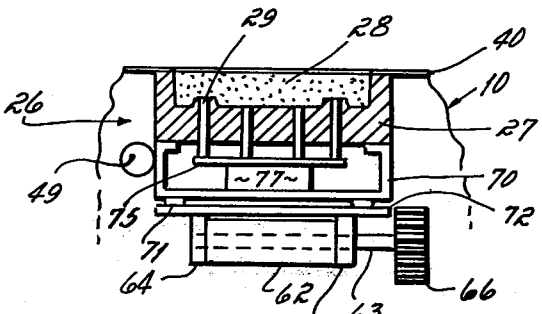
FIG. 8 is a diagrammatic cross-sectional view taken along lines 8—8 of FIG. 7.

That conveyor is indicated at 60 and, as can be seen from FIG. 6, lies generally tangentially to the circular frame which carries the patterns. It also underlies the patterns so that at the eject station when the pattern is turned upside-down and the core is ejected, the core will drop onto the conveyor. The conveyor also has a slight downward slope so that the core can move down and away from the pattern as it is being carried away by the conveyor. The mechanism by which the pattern is rotated is substantially as that disclosed in U.S. Pat. No. 4,083,396. As indicated in the drawings, with particular reference to FIG. 7, the tooling is rotatably mounted on a bracket 62 which projects radially from the frame. Extending laterally of the bracket 62 is a shaft 63 which is journalled in the bracket 62 and which is fixed to the tooling by upstanding lugs 64 (FIG. 9). The shaft carries a pinion 66 which is engageable by a rack 67. The rack is carried on the end of a piston which is in a double-acting cylinder 68 fixed to the frame. When air or hydraulic fluid is introduced into the piston in one end, the rack extends to cause the tooling, including the pattern, to rotate in clockwise direction as viewed in FIG. 7 through 180° until the pattern is upside-down. When fluid is introduced into the opposite end of the cylinder 68, the rack retracts to rotate the pattern into its reversed, upright position.

Figure 7:
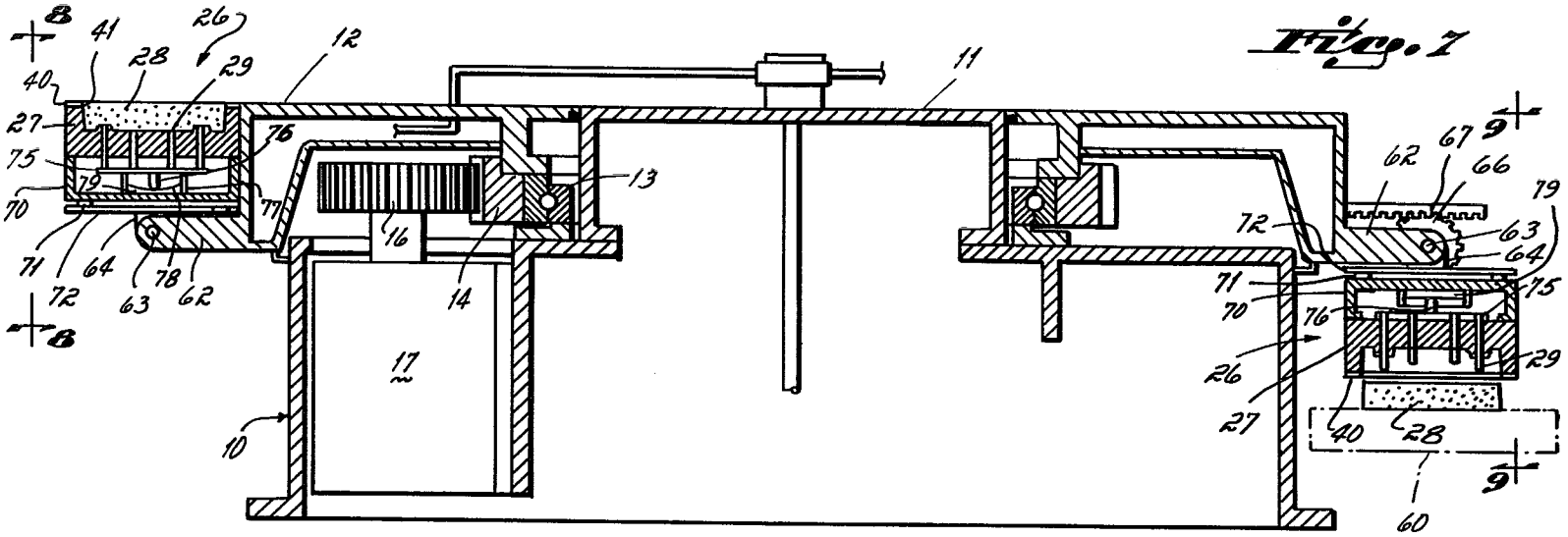
FIG. 7 is a cross-sectional view taken along lines 7—7 of FIG. 6.

The stripper pins can be cam operated in a manner similar to that described in the first embodiment with the modifications necessary to reflect the fact that the pattern is in an upside-down attitude when the stripper pins are to be actuated. Alternatively, and as illustrated in FIG. 7, a pneumatic ejector can be employed. As shown in FIG. 7, a box-shaped tooling carrier 70 is supported by means of bolts and bellville washers 71 to a plate 72 to which the lugs 64 are fixed. The stripper pins 29 are mounted on a plate 75 which has a depending lug 76 fixed to it. Surrounding the lug 76 is a cylinder 77 across which a diaphragm 78 is mounted. The diaphragm 78 is engageable with the depending lug 76. Pneumatic means, not shown, is connected to the cylinder 77. When air under pressure is introduced between the carrier 70 and the diaphragm 78, namely, into the cavity 79, the diaphragm will flex toward the pattern driving the plate 75 toward the pattern and causing the stripper pins to move through the pattern to strip the core.

The stripping operation is generally as follows. After the core has cured and the cured core with its tooling has reached the eject station, the cylinder 68 is actuated to cause the tooling to rotate to the upside-down position as shown at the right-hand side of FIG. 7. At this point, the ejector pins are actuated to force the core out of the pattern and onto the conveyor 60. After the core has been dropped out of the pattern, the fluid to the cylinder 68 is reversed to cause the tooling to rotate to its upright position. Thereafter, the pattern is cleaned, sprayed and recharged in a manner previously described.

Having described my invention, I claim:

1. A no-bake molding machine comprising, a base, a generally circular frame mounted for rotation on said base, a plurality of concave patterns mounted around the circumference of said frame, plate means surrounding said patterns and extending around the perimeter of said frame to form with said patterns a substantially flush, flat, continuous surface around the top of said frame surrounding said concave patterns, means for continuously rotating said frame, a mixer for filler located adjacent said frame and having a discharge spout overlying said patterns and continuous surface, said mixer and filler mixing sand with a no-bake binder and depositing sand and binder on said patterns and continuous surface, and a stationary plow adjacent the mixer and filler engaging said plate means for scraping excess sand off said surface and leveling the sand in each pattern as it passes under said plow.

2. A no-bake machine as in claim 1, further comprising, automatic core-ejecting means spaced around said frame from said mixer and filler.

3. A no-bake machine as in claim 2 in which said ejecting means comprises, a cam located adjacent said ejecting means, a plurality of stripping pins slidably mounted for vertical movement through each said pattern, a follower engageable with said cam to move said follower, and means connecting said stripper pins to said cam to move said pins through said pattern, ejecting a core within said pattern, when said follower is moved by said cam.

4. A no-bake machine as in claim 1 further comprising, means for rotating said pattern with respect to said frame from an upwardly-facing position to a downwardly-facing position, means for ejecting a core from said pattern when said pattern is in a downwardly-facing position, and a conveyor underlying said pattern for removing an ejected core.

5. A no-bake machine as in claim 1, further comprising, a pattern support bracket projecting radially from said frame at each pattern location, said patterns being removably mounted on said brackets, said plate means comprising a plurality of plate segments each surrounding the upper perimeter of a respective pattern, adjacent plate segments having abutting radial surfaces whereby said plate segments form a substantially continuous circular surface.

6. A no-bake core and mold-making machine comprising, a base, a frame, rotatably mounted on said base, drive means for continuously rotating said frame, a plurality of horizontal plate segments mounted on said frame in end-to-end abutting relation to form a circular continuous surface, each said plate having an opening, at least one pattern mounted in said opening and filling said opening, means for supplying a mixed sand and no-bake binder continuously to the surface formed by said plate segments, a stationary plow adjacent said filling station to wipe excess sand from one pattern across adjacent plates to the next pattern as said plates are carried by said frame under said plow, and means for ejecting a bonded aggregate from a pattern.

7. A no-bake machine as in claim 6 further comprising, in sequence between said ejecting means and said supplying means, means for blowing sand out of said patterns, means for spraying a release agent onto said patterns, and means for drying said release agent.

* * * * *